US006391122B1

(12) United States Patent
Votteler et al.

(10) Patent No.: US 6,391,122 B1
(45) Date of Patent: May 21, 2002

(54) SEGMENTED PROCESS FOR CLEANING-IN-PLACE

(75) Inventors: Robert Adolf Votteler, Cincinnati; Maynard Joseph Riley, Mason, both of OH (US)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/447,646

(22) Filed: Nov. 23, 1999

(51) Int. Cl.[7] ..... B08B 3/00; B08B 3/08; B08B 9/00; B08B 9/027; B08B 9/093

(52) U.S. Cl. ..... 134/36; 134/22.1; 134/22.11; 134/22.12; 134/22.14; 134/22.18; 134/22.19; 134/25.1; 134/25.3; 134/26; 134/28; 134/10

(58) Field of Search ..... 134/22.1, 22.11, 134/22.12, 22.14, 22.18, 22.19, 26, 25.1, 25.3, 28, 36, 10

(56) References Cited

U.S. PATENT DOCUMENTS

| | | | | |
|---|---|---|---|---|
| 4,715,980 A | * | 12/1987 | Lopes et al. | |
| 5,047,164 A | * | 9/1991 | Corby | 134/25.3 |
| 5,064,561 A | * | 11/1991 | Rouillard | |
| 5,348,058 A | * | 9/1994 | Ruhl | 141/1 |
| 5,533,552 A | * | 7/1996 | Ahlers | 141/144 |
| 5,888,311 A | * | 3/1999 | Laufenberg et al. | 134/10 |
| 6,071,356 A | * | 6/2000 | Olsen | 134/26 |

* cited by examiner

*Primary Examiner*—Zeinab El-Arini
(74) *Attorney, Agent, or Firm*—Edward A. Squillante, Jr.

(57) ABSTRACT

A novel cleaning-in-place process is described. The process is one which is segmented, and unused solution is pumped through more than two components of a machine targeted for cleaning, disinfecting or both. The process also results in superior cleaning in shorter cleaning cycles.

19 Claims, 4 Drawing Sheets

SEGMENTED PROCESS FOR CLEANING-IN-PLACE

FIELD OF THE INVENTION

This invention is directed to a novel cleaning-in-place (CIP) process. More particularly, the invention is directed to a CIP process that is segmented, and surprisingly, does not require solution to be circulated to every component of a machine subjected to water in order to obtain superior cleaning and/or disinfecting results.

BACKGROUND OF THE INVENTION

It is extremely important to clean food processing facilities like breweries, dairy plants and carbonated beverage plants (non-fermentative soda plants). Typically, such food processing facilities are cleaned by subjecting the internal portions of the machines that make up the facilities to a solution that reacts with the various soils present within the machines.

A conventional CIP system, for example, has several storage containers. Each storage container, independently, houses a solution (e.g., pre-rinse solution, cleaning solution, rinsing solution) that is fed (non-simultaneously) into the facility targeted for cleaning or decontamination. Typically, the solutions are pumped into the liquid passages of the machines of the facilities being cleaned and circulated through the machines until they are finally discharged to waste.

Conventional CIP processes are known for employing a pump that circulates a cleaning solution throughout the machines of the facilities being cleaned. During such conventional processes, the unused cleaning solution is fed into no more than two components, regardless of how many components or segments the machine targeted for soil removal has. What this means is that if a particular facility has, for example, carbonated beverage filling machines, conventional CIP processes feed unused cleaning solution into no more than two components of the machine, even if the machine is made up of many parts, like deaerators, storage and mixing tanks, as well as carbonation and cooling tanks. Therefore, only the first two components of the machine receiving cleaning solution are subjected to virgin or unused solution and all other components receive used cleaning solution. Also, conventional cleaning processes are not efficient since every part of the machine gets cleaning solution, even parts like deaerators that are only subjected to large volumes of water.

The disadvantages of cleaning via well known CIP processes is that used soil and contaminant carrying cleaning solutions are circulated throughout the components of the machines being cleaned. Such processes unequivocally result in inferior cleaning. Moreover, conventional CIP processes are not efficient since every part of the machine targeted for cleaning gets cleaning solution, even if the part is one that is only subjected to large volumes of water.

It is of increasing interest to develop efficient processes that thoroughly clean and/or disinfect processing equipment. This invention, therefore, is directed to a novel cleaning-in-place process that is segmented, and surprisingly, results in superior cleaning, disinfecting, or both without the need to circulate solutions through all parts of a machine.

BACKGROUND REFERENCES

Efforts have been disclosed for cleaning processing equipment. In U.S. Pat. No. 5,888,311, a process for cleaning equipment in the absence of a pre-rinse step is described.

Other efforts have been disclosed for cleaning equipment. In U.S. Pat. No. 5,533,552, a CIP process comprising the step of circulating a cleaning liquid throughout equipment targeted for cleaning is described.

Still other efforts have been described for cleaning equipment. In U.S. Pat. No. 5,064,561, a two part CIP system is described and the system utilizes an alkaline material and an enzyme.

SUMMARY OF THE INVENTION

In a first aspect, the present invention is directed to a cleaning in place process comprising the steps of:

a) supplying an unused solution to more than two components of a machine targeted for cleaning, disinfecting or both;

b) generating spent solution; and c) removing said spent solution through at least one outlet of the machine.

In a second aspect, the present invention is directed to a cleaning in place process comprising the steps of:

a) supplying an unused solution to more than two components of a machine targeted for cleaning, disinfecting or both;

b) generating spent solution; and c) removing said spent solution through at least one outlet of the machine wherein the unused solution is not supplied to a part of the machine that is only subjected to water and holds more than about 5.0% of the total volume of solution in the machine, and no more than about 5.0% of the spent solution generated is mixed prior to exiting the machine.

In a third aspect, the present invention is directed to a cleaning in place process comprising the steps of:

a) pumping through at least one CIP unit an unused solution to more than two components of a machine targeted for cleaning, disinfecting or both;

b) generating spent solution; and c) removing said spent solution through at least one outlet of the machine.

Percent (%), as used herein, means percent by volume based on the total interior volume of the machine targeted for cleaning, disinfecting or both. Unused solution, as used herein is defined to mean solution that has never been used, or solution that has been used and subsequently cleaned (e.g., cleaned, filtered) to substantially its unused form, or a mixture thereof.

BRIEF DESCRIPTION OF THE DRAWING

The subject matter which is regarded as the invention is particularly pointed out and distinctly claimed in the concluding portion of the specification. The Invention, however, may be best understood by reference to the following description taken in conjunction with the accompanying drawing figures in which:

DETAILED DESCRIPTION OF THE PREFERRED EMBODIMENTS

Figure 1:
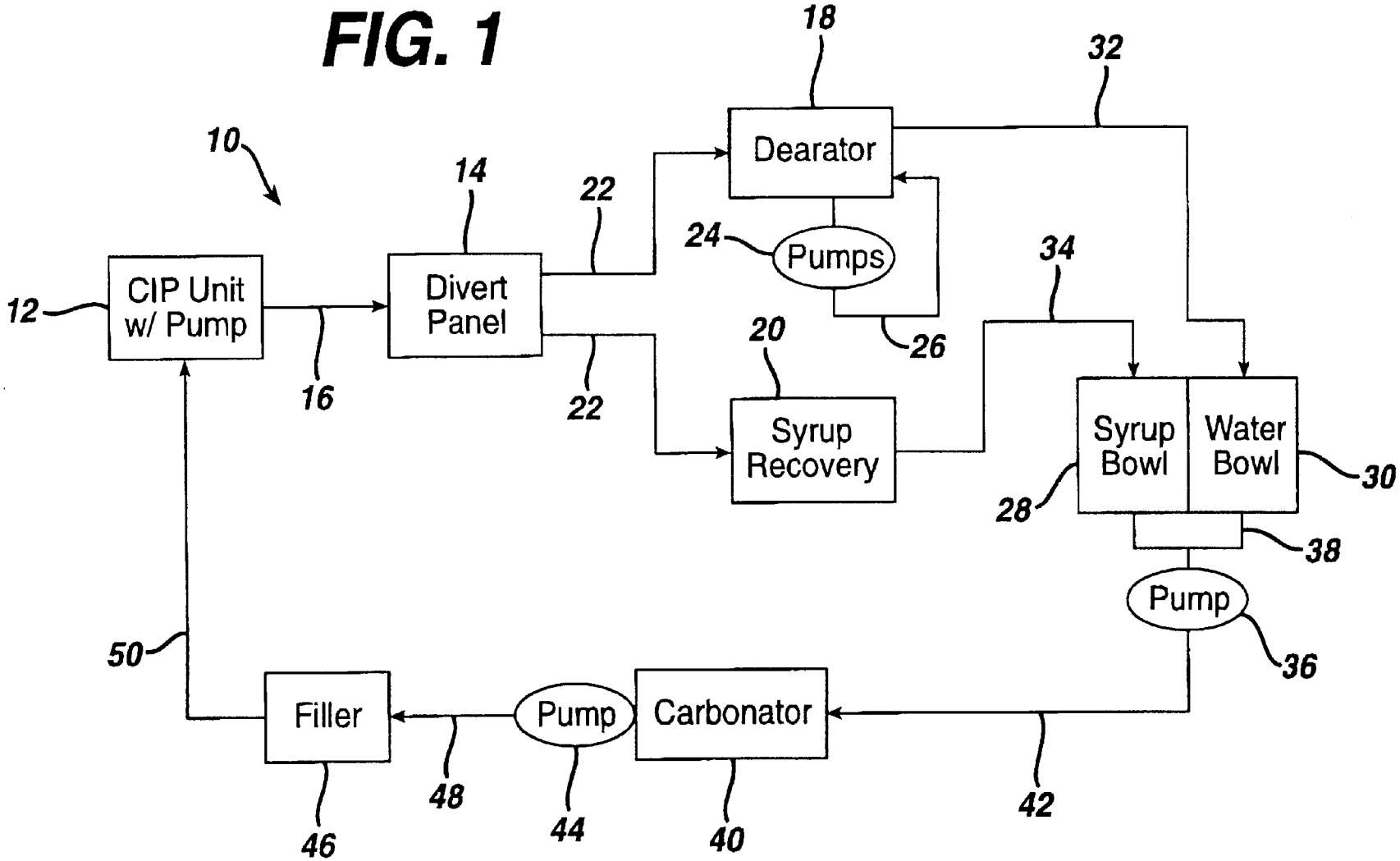
FIG. 1 is a schematic drawing of a carbonated beverage filler machine being subjected to a conventional CIP process.

Referring to FIG. 1, a schematic drawing of a carbonated beverage filler machine being subjected to a conventional CIP process 10 is shown. The CIP unit (pump in combination with unused solution storage tank) 12 pumps, for example, unused cleaning solution (not shown) to a divert panel 14 by way of a pipe or conduit 16. The divert panel 14 diverts the cleaning solution to a dearator 18 and a syrup recovery tank 20 via divert panel exit conduits 22. The dearator 18 may also comprise a dearator pump 24 having pump conduit 26 to circulate spent cleaning solution (not shown) within the dearator 18. The CIP unit pumps spent cleaning solution out of the dearator 18 to the water bowl 30 and out of the syrup recovery tank 20 to the syrup bowl 28. The spent cleaning solution is carried from the dearator 18 to the water bowl 30 via the dearator outlet 32 and from the syrup recovery tank 20 to the syrup bowl 28 via the syrup recovery tank outlet 34. The syrup bowl 28 and water bowl 30 may also comprise a bowl pump 36 with bowl pump conduit 38 to circulate or drive resulting mixed spent cleaning solution out of the syrup bowl 28 and water bowl 30. The spent cleaning solution is then pumped to the carbonator 40 from the carbonator inlet conduit 42. From the carbonator 40, the spent cleaning solution is pumped via carbonator pump 44 to the filler 46 by way of the exit conduit 48. The spent cleaning solution then exits the filler 46 and is returned, via filler exit conduit 50, to the CIP unit 12.

As can be seen from the conventional CIP process described in FIG. 1, only the syrup recovery tank 20 and the dearator 18 receive unused cleaning solution. However, the dearator 18 is only subjected to water during the normal bottle filling process. Thus, the conventional CIP process is inferior and inefficient since a very high liquid volume part of a machine, the dearator 18 (about 30% of the machine's volume) which is only subjected to water, is loaded with unused cleaning solution. The spent cleaning solution exiting the dearator 18 is then mixed with spent cleaning solution from the syrup recovery tank 20 after the dearator 18 and syrup recovery tank 20 feed spent cleaning solution to the water bowl 30 and syrup bowl 28, respectively. The resulting mixture of spent cleaning solution (about 40% of the total volume of spent cleaning solution mixed within the machine) is then continued to be used for cleaning. From the syrup bowl 28 and water bowl 30, spent cleaning solution is fed to the carbonator 40 and filler 46, both of which are high volume (collectively, about 50% of the machine's volume), have high levels of soil, and are only subjected to spent cleaning solution. The end result, therefore, of the conventional CIP process is equipment having been subjected to an inferior cleaning process. Such a conventional process is inferior because largely soiled parts of the machine targeted for cleaning are subjected to spent (used) cleaning solution. Also, conventional processes take long because all components of the machine are subjected to solution.

Figure 2:
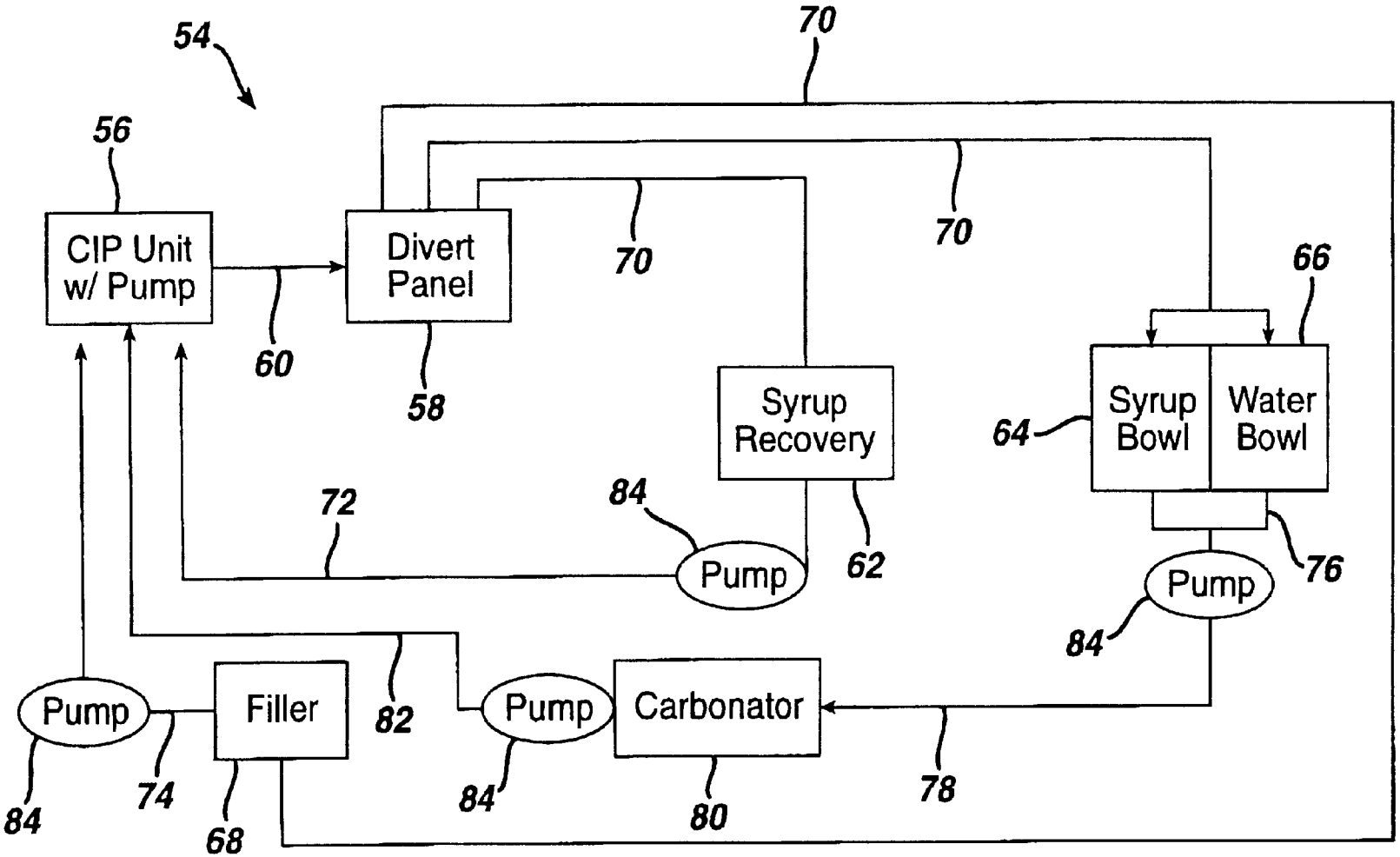
FIG. 2 is a schematic drawing of a carbonated beverage filler machine being subjected to the superior CIP process of this invention.

Referring to FIG. 2, a schematic diagram of a carbonated beverage filler machine being subjected to the superior CIP process 54 of this invention is shown. A CIP unit 56 pumps solution (not shown) to a divert panel 58 by way of a pipe or conduit 60. The divert panel 58 diverts the unused cleaning solution to a syrup recovery tank 62, a syrup bowl 64, a water bowl 66 and a filler 68 via divert panel exit conduits 70. Therefore, in the superior process of this invention, more than two components of a machine are fed unused solution that cleans and/or disinfects the machine. As can be seen from FIG. 2, the superior process of this invention takes used solution from the syrup recovery tank 62 to the CIP unit 56 by way of the syrup recovery tank outlet 72. Used solution from the filler 68 is taken to the CIP unit 56 via the filler exit conduit 74. Moreover, used solution exiting the syrup bowl 64 and water bowl 66 exits the same via pump conduit 76 which feeds used solution through a carbonator inlet conduit 78 to a carbonator 80. From the carbonator 80, used solution is delivered to the CIP unit 56 by way of the exit conduit 82. Therefore, as a result of the superior process of this invention, components only subjected to water and holding more than 5.0% of the total volume of fluid in the machine (e.g., dearator) are not fed solution. Also, no more than about 5.0%, and preferably, from about 0.01% to about 4.5%, and most preferably, from about 0.02% to bout 1.0% of the spent solution generated is mixed prior to exiting the machine. As used herein, spent solution is defined to mean solution having passed through a component of the machine being cleaned (e.g., a syrup recovery tank), excluding conduit.

As can be seen from the present process, cleaning, disinfecting or both is faster because large components of the machine subjected only to water are not fed solution and all components being cleaned with unused solution are being subjected to unused solution at the same time. Also, cleaning, disinfecting or both is better than conventional processes because substantially less spent solution is circulated in the machine being cleaned. The pumps 84 depicted in FIG. 2 are for illustration purposes and optional. Preferably, the pumps 84 are used, and most preferably, each pump 84 is positioned after a component (e.g., a carbonator).

Figure 3:
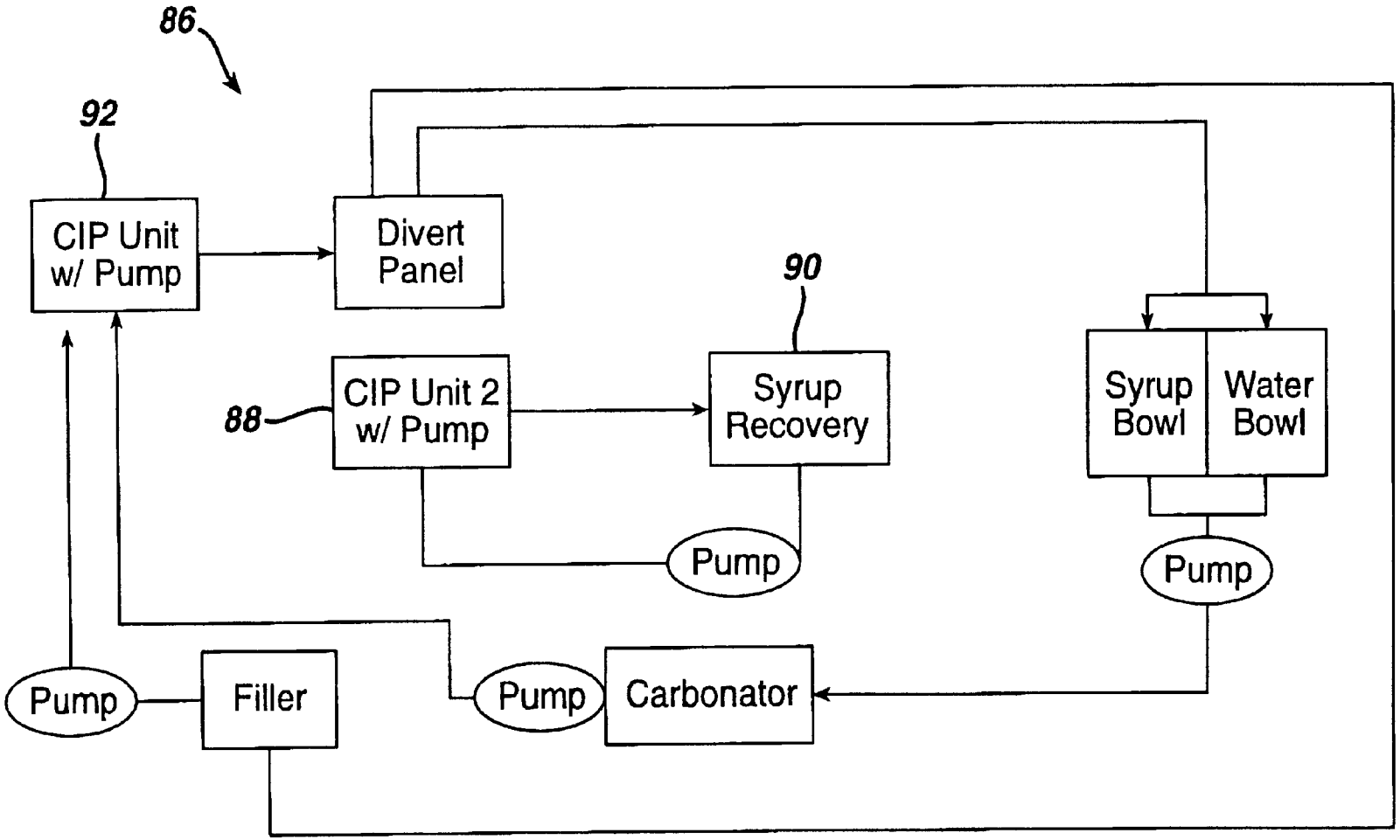
FIG. 3 is a schematic drawing of a carbonated beverage filler machine being subjected to the superior CIP process of this invention wherein more than one CIP unit is employed.

In FIG. 3, a schematic diagram of a carbonated beverage filler machine being subjected to the superior CIP process (with preferred embodiment) 86 of this invention is shown. In the preferred CIP process, a second CIP unit 88 is used to independently pump unused solution (not shown) to a syrup recovery tank 90. Therefore, the second CIP unit 88 pumps unused solution only to the syrup recovery tank 90, and all other components that receive unused solution are fed the unused solution via an independent CIP unit 92.

The solutions which may be used in the process of the present invention are limited only to the extent that they are the type of solutions used to clean and/or disinfect machines of processing facilities, like breweries, dairy plants and carbonated beverage plants. Such solutions may generally be classified as cleaning solutions, disinfecting solutions, cleaning and disinfecting solutions or rinsing solutions. The cleaning solutions, for example, that may be used in this invention include phosphoric acid comprising detergents, and detergents comprising mixtures of inorganic and organic acids. The former are sold under the name of Elevate and Sentol and the latter is sold under the name of Super Dilac, all of which are made commercially available by Diversey-Lever. Other cleaners which may be used in the superior process of this invention include enzymatic cleaners sold under the name of Diver Silver and alkaline cleaners sold under the name Divo-Flow, both of which are made commercially available by DiverseyLever.

The sanitizers which may be used in this invention include bleaches, sold under the name of Dibac and Diversol, organochlorine donors sold under the name of Antibac and Multi-Chlor, iodine donors sold under the name Divosan MH and Accord II, acid anionics (e.g., phosphoric acid and dodecylbenzene sulfonic acid) sold under the name of Demand, Dividend and Per-Vad, and peroxyacetic acid based sanitizers sold under the name of Divosan Activ. Sanitizer and cleaning agents may also be employed and they are sold under the name of Divosan DB and Divosan X-Tend, all of the above are made commercially available by DiverseyLever.

The preferred sanitizer and cleaning agents that may be used in this invention are further described in U.S. Pat. No. 4,715,980, the disclosure of which is incorporated herein by reference.

The most preferred solution that is used with the superior process described herein is a cleaning in place solution comprising a halogen dioxide. The preferred halogen dioxide is chlorine dioxide and such a solution is further described in Application Ser. No. 09/447,644 filed Nov. 23, 1999, commonly assigned to DiverseyLever, the disclosure of which is incorporated herein by reference.

The rinsing solutions which may be used in this invention include water, as well as aqueous solutions comprising low foaming surfactants like fatty acid or alcohol condensates made available by ICI surfactants, Henkel, Shell Chemical Company and BASF. Many of these surfactants are sold under the name Neodol®, Plurafac® and Dehypon.

The superior process of the present invention typically circulates solution through the machine targeted for cleaning, disinfecting or both at a rate (linear velocity) from about 1.5 to about 2.5 meters per second, whereby the rate is established in the largest diameter conduit of the machine being cleaned.

Also, the superior process of this invention is calculated to be about 100% to about 650%, and preferably, from about 300% to about 600% faster than the conventional process shown in FIG. 1.

It is also noted herein that when unused solution is supplied to the machine targeted for cleaning, disinfecting or both, via the process of this invention, it is preferred that the unused solution be pumped into the machine, intermittently. This means that the solution is pumped into the machine from about two seconds to about two minutes, and preferably, from about five seconds to abut 1.5 minutes, and most preferably, from about ten seconds to about one minute, followed by a resting period (no pumping or flow of solution) from about two seconds to about two minutes, and preferably, from about five seconds to abut 1.5 minutes, and most preferably, from about ten seconds to about one minute. Such intermittent pumping of solution minimizes the mixing of solutions that may be recirculated, thereby making cleaning, disinfecting or both more efficient. Also, during the resting period it is preferred the machine being subjected to solution be drained.

The prophetic example which follows below is provided to further illustrate and facilitate an understanding of the present invention. Therefore, the example is not meant to be limiting and modifications which fall within the scope and spirit of the claims are intended to be within the scope and spirit of the present invention.

EXAMPLE

Figure 4B:
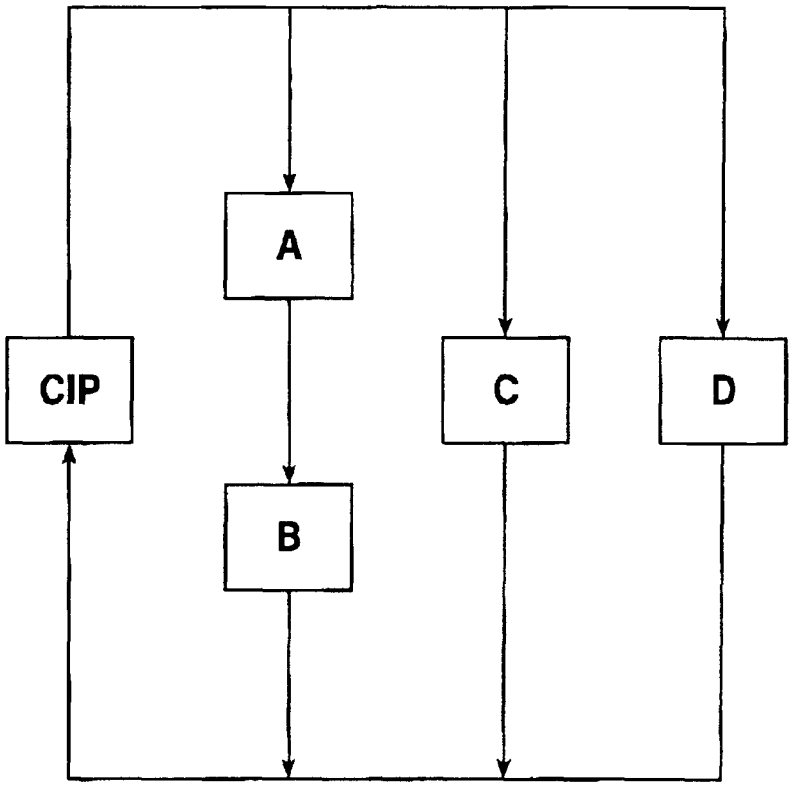
FIG. 4*a* is a schematic drawing of a carbonated beverage machine being subjected to a conventional CIP process and FIG. 4*b* is a schematic diagram of a carbonated beverage machine being subjected to the superior CIP process of this invention, both of which are discussed in the example.
Figure 4A:
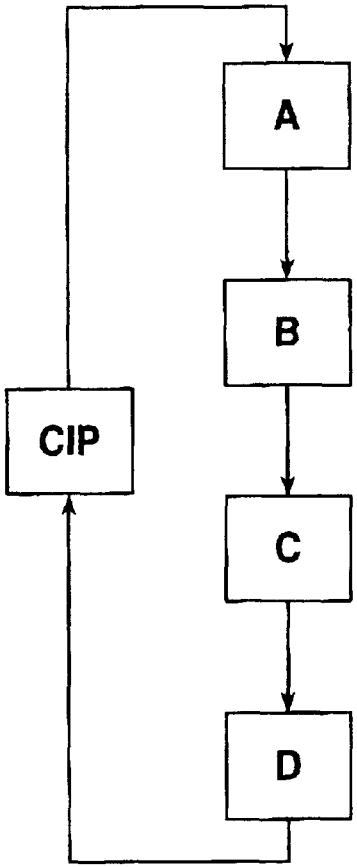

A carbonated beverage filling machine may be cleaned in the manner outlined in FIGS. 4*a* and 4*b*. When calculating the time to clean such a machine, via the conventional process outlined in FIG. 4*a* and via the process of this invention outlined in FIG. 4*b*, the residence time (RT) of the solution supplied in the machine and the soil conditions of each component of the machine being cleaned must be considered. In the current prophetic example, we assumed soil conditions to be the same for each machine subjected to solution. For both machines (e.g., the machine that may be subjected to the process set out in FIG. 4*a* and the machine being subjected to the process set out in FIG. 4*b*) we assumed the following would be required:

Pre-rinse for a period of 3 residence times;

Wash for a period of 4 residence times; and

Post-rinse for a period of 3 residence times.

Table I below depicts the time it would take to clean a carbonated beverage machine via the conventional process set forth in FIG. 4*a*, and Table II depicts the time it would take to clean the same carbonated beverage machine with the process of this invention. As may be seen from the numbers, the conventional process would take 105 minutes and the process of this invention would take 35 minutes (i.e., time to complete the slowest step). Leg, as used herein, is defined to mean portion.

TABLE I

| Step | 1 RT secs | Total RTs (secs) | Comment |
|---|---|---|---|
| Current configuration | | | |
| Pre-rinse A | 20 | 200 | parts B, C, and D still need pre-rinse |
| Pre-rinse B | 40 | 400 | parts C, and D still need pre-rinse |
| Pre-rinse C | 60 | 600 | part D still needs pre-rinse |
| Pre-rinse D | 90 | 900 | complete system pre-rinsed |
| Wash A | 20 | 200 | parts B, C, and D still dirty |
| Wash B | 40 | 400 | parts C, and D still dirty |
| Wash C | 60 | 600 | part D still dirty |
| Wash D | 90 | 900 | complete system pre-rinsed and washed |
| Post-rinse A | 20 | 200 | parts B, C, and D still need post-rinse |
| Post-rinse B | 40 | 400 | parts C, and D still needs post-rinse |
| Post-rinse C | 60 | 600 | part D still needs post-rinse |
| Post-rinse D | 90 | 900 | complete system pre-rinsed, washed, and post-rinsed |
| total time required: | | 6300 | seconds |
| | | 105 | minutes |

TABLE II

| Step | 1 RT secs | Total RTs (secs) | Comment |
|---|---|---|---|
| Proposed configuration - Leg A–B | | | |
| Pre-rinse A | 20 | 200 | part B still needs pre-rinse |
| Pre-rinse B | 50 | 500 | leg A–B pre-rinsed |
| Wash A | 20 | 200 | part B still dirty |
| Wash B | 50 | 500 | leg A–B pre-rinsed and washed |
| Post-rinse A | 20 | 200 | part B still needs post-rinse |
| Post-rinse B | 50 | 500 | leg A–B pre-rinsed, washed and post-rinsed |
| total time required | | 2100 | seconds |
| | | 35 | minutes |
| Proposed configuration - Leg C | | | |
| Pre-rinse C | 50 | 500 | |
| Wash C | 50 | 500 | |
| Post-rinse C | 50 | 500 | |
| total time required | | 1500 | seconds |
| | | 25 | minutes |
| Proposed configuration - Leg D | | | |
| Pre-rinse C | 70 | 700 | |
| Wash C | 70 | 700 | |
| Post-rinse C | 70 | 700 | |
| total time required | | 2100 | seconds |
| | | 35 | minutes |

What is claimed is:

1. A cleaning-in-place process comprising the steps of:

a) supplying an unused solution to more than two components of a machine targeted for cleaning, disinfecting or both;

b) generating spent solution, and c) removing said spent solution through at least one outlet of the machine, wherein the unused solution is not supplied to a part of the machine that is only subjected to water and holds more than 5.0% of total volume of solution in the machine, and no more than 5.0% of the spent solution generated during the CIP process is mixed within the machine prior to exiting the machine.

2. The cleaning-in-place process according to claim 1 wherein the solution is a cleaning, sanitizing, rinsing or sanitizing and cleaning solution.

3. The cleaning-in-place process according to claim 2 wherein the solution is a cleaning solution and the cleaning solution comprises phosphoric acid or an enzyme.

4. The cleaning-in-place process according to claim 2 wherein the solution is a disinfecting solution and the disinfecting solution comprises an organochlorine donor, iodine donor, phosphoric acid, dodecylbenzene sulphonic acid or peroxyacetic acid.

5. The cleaning-in-place process according to claim 2 wherein the solution is a rinsing solution and the rinsing solution comprises a low foaming surfactant.

6. The cleaning-in-place process according to claim 1 wherein the machine is a carbonated beverage filling machine.

7. The cleaning-in-place process according to claim 6 wherein unused solution is supplied into at least three components of the machine.

8. The cleaning-in-place process according to claim 7 wherein the three components are a syrup recovery tank, a filler and a syrup bowl or water bowl.

9. The cleaning-in-place process according to claim 6 wherein the unused solution is supplied into four components.

10. The cleaning-in-place process according to claim 9 wherein the four components are a syrup recovery tank, a filler, a syrup bowl and a water bowl.

11. The cleaning-in-place process according to claim 6 wherein the process comprises two CIP units to supply unused solution to the machine.

12. The cleaning-in-place process according to claim 11 wherein one of the two CIP units supplies unused solution only to a syrup recovery tank.

13. The cleaning-in-place process according to claim 1 wherein the process further comprises the step of supplying the unused solution into the machine intermittently.

14. The cleaning-in-place process according to claim 13 wherein the solution is intermittently supplied to the machine by pumping solution for about two seconds to about two minutes followed by a resting period for about two seconds to about two minutes.

15. The cleaning-in-place process according to claim 1 wherein the process utilizes one CIP unit to supply unused solution to the machine.

16. The cleaning-in-place process according to claim 1 wherein the unused solution comprises a halogen dioxide.

17. The cleaning-in-place process according to claim 16 wherein the halogen dioxide is chlorine dioxide.

18. A machine having been washed by a cleaning-in-place process, said process comprising the steps of:

a) supplying an unused solution to more than two components of the machine;

b) generating spent solution; and c) removing said spent solution through at least one outlet of the machine wherein the unused solution is not supplied to a part of the machine that is only subjected to water and holds more than 5.0% of total volume of solution in the machine, and no more than 5.0% of the spent solution generated during the CIP process is mixed within the machine prior to exiting the machine.

19. The machine according to claim 18 wherein the machine is a non-fermentative carbonated beverage filling machine.

* * * * *